US006886229B1

(12) United States Patent
Wilson

(10) Patent No.: US 6,886,229 B1
(45) Date of Patent: May 3, 2005

(54) HINGE PIN REMOVER TOOL

(76) Inventor: Sean F. Wilson, 2537 Buena Rosa, Fallbrook, CA (US) 92028

( * ) Notice: Subject to any disclaimer, the term of this patent is extended or adjusted under 35 U.S.C. 154(b) by 0 days.

(21) Appl. No.: 10/718,468

(22) Filed: Nov. 20, 2003

(51) Int. Cl.[7] ..... B25B 27/14
(52) U.S. Cl. ..... 29/267; 29/278
(58) Field of Search ..... 29/267, 270, 240, 29/278, 235; 254/25; 81/451, 461

(56) References Cited

U.S. PATENT DOCUMENTS 549,895 A * 11/1895 Browne ..... 254/25
960,193 A * 5/1910 Peterson ..... 7/165
D256,442 S * 8/1980 Martin ..... D10/77
5,253,406 A * 10/1993 Shere et al. ..... 29/240
5,495,651 A * 3/1996 Tsuha ..... 29/235

* cited by examiner

*Primary Examiner*—Lee D. Wilson
(74) *Attorney, Agent, or Firm*—Loyal McKinley Hanson

(57) ABSTRACT

A tool for removing a hinge pin from a hinge includes an elongated member having a proximal end portion and a distal end portion, a handle on the proximal end portion for a user to grasp in a hand of the user, and a forked tip on the distal end portion for the user to wedge between a hinge pin head and a hinge for purposes of facilitating hinge removal. The forked tip includes spaced apart first and second hinge-pin-dislodging tongs that define a channel having a width larger than the hinge pin shaft diameter and smaller than the hinge pin head diameter in order to enable the channel to receive the hinge pin shaft as the user wedges the first and second hinge-pin-dislodging tongs between the hinge pin head and the hinge.

3 Claims, 3 Drawing Sheets

Fig. 4
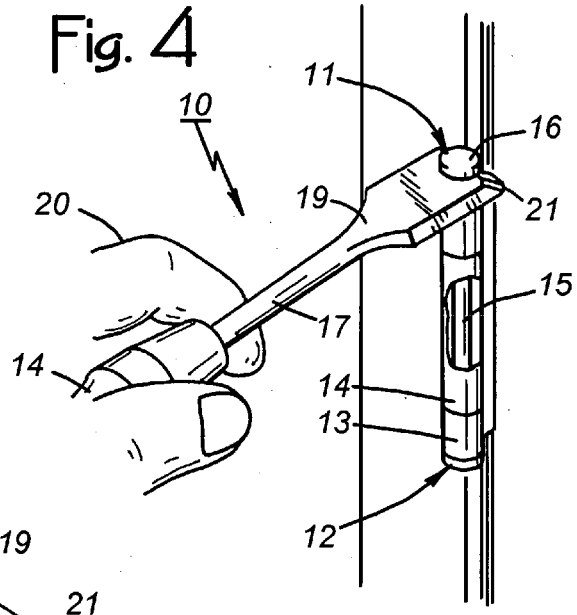
Fig. 5
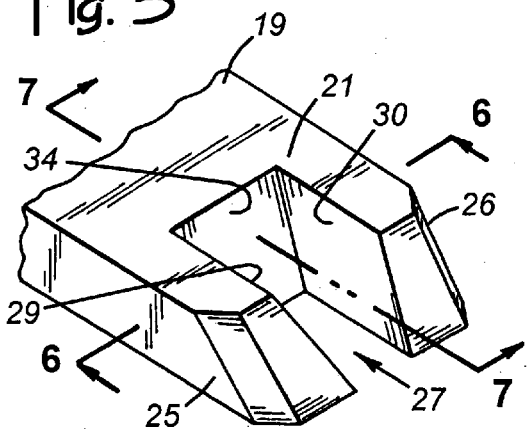
Fig. 6a
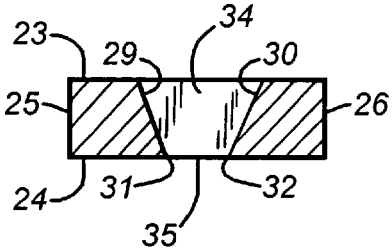
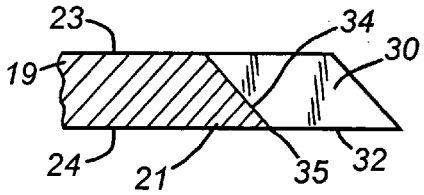
Fig. 7
Fig. 6b
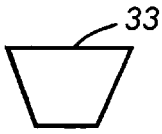

HINGE PIN REMOVER TOOL

BACKGROUND OF THE INVENTION

1. Technical Field

This invention relates generally to hand tools, and more particularly to a hand tool for removing a hinge pin from a door hinge or other hinge.

2. Description of Related Art

A typical door hinge includes a first hinge section that mounts on a door and a second hinge section that mounts on a vertically disposed framing member at the door opening. The task of mounting a door on the framing member with multiple hinges proceeds by mounting the first and second hinge sections of each hinge on the framing member and the door. Next, the installer positions the door by the door opening and aligns the two hinge sections of each hinge. Then, the installer inserts removable hinge pins in the hinges that function to hold the two sections of the hinges together pivotally. The above applies to various types and kinds of hinges other than just door hinges.

Removing the door proceeds in reverse order by first removing the hinge pins. That is where certain problems can arise. Over time, the hinge pin shaft often becomes tightly lodged in place, through corrosion or otherwise, making removal very difficult. Existing methods of dislodging such a hinge pin include placing a screwdriver blade under the head of the hinge pin and tapping the screwdriver handle with a hammer or the heel of the hand. But that does not always work very well and it can result in objectionable scratches to the hinge pin and elsewhere on the hinge. Thus, a need exists for a better way to remove such a hinge pin.

SUMMARY OF THE INVENTION

This invention addresses the concerns outlined above by providing a dedicated hinge pin remover tool having a forked tip that fits under the hinge pin head. The user wedges the forked tip between the hinge pin head and the rest of the hinge and then dislodges the hinge pin with a prying action of the forked tip against the hinge pin head.

To paraphrase some of the more precise language appearing in the claims and further introduce the nomenclature used, the invention provides a tool for removing a hinge pin from a hinge when the hinge pin includes a hinge pin shaft with a predetermined hinge pin shaft diameter (e.g., 9/32 of an inch) and a hinge pin head with a predetermined hinge pin head diameter (e.g., ½ of an inch) that is larger than the hinge pin shaft diameter. The tool includes an elongated member (e.g., a shaft) having a proximal end portion and a distal end portion, a handle on the proximal end portion of the elongated member for a user to grasp in a hand of the user, and a forked tip (i.e., bifurcated) on the distal end portion of the elongated member for the user to wedge between the hinge pin head and the hinge for purposes of facilitating hinge removal.

The forked tip includes spaced apart first and second hinge-pin-dislodging tongs. The tongs define a channel having a width between the first and second tongs that is larger than the hinge pin shaft diameter and smaller than the hinge pin head diameter. That enables the channel to receive the hinge pin shaft as the user wedges the first and second hinge-pin-dislodging tongs between the hinge pin head and the hinge.

In one preferred embodiment, the first and second hinge-pin-dislodging tongs are beveled inwardly toward each other to better enable the user to wedge the first and second tongs between the hinge pin head and the rest of the hinge. In addition, the elongated member is composed of metal, the channel has a uniform cross section, and the channel has a width slightly greater than 9/32 of an inch wide in order to accommodate a 9/32-inch diameter hinge pin shaft.

Thus, the invention provides a dedicated hinge pin remover tool that facilitates the removal of a hinge pin. The following illustrative drawings and detailed description make the foregoing and other objects, features, and advantages of the invention more apparent.

BRIEF DESCRIPTION OF THE DRAWINGS

FIG. 4 is a perspective view showing the tool in use to remove the hinge pin of a door hinge;

FIG. 5 is an enlarged isometric view of a tip portion of the tool;

FIG. 6*a* is a cross-sectional elevation view of the tip portion as viewed in a plane containing a line 6—6 in FIG. 5;

FIG. 6*b* is a diagrammatic representation of the uniform trapezoidal cross section of the channel shown in FIG. 6*a* between the first and second hinge-pin-dislodging tongs;

FIG. 7 is a cross-sectional elevation view of the tip portion as viewed in a plane containing a line 7—7 in FIG. 5.

DESCRIPTION OF THE PREFERRED EMBODIMENTS

Figure 1:
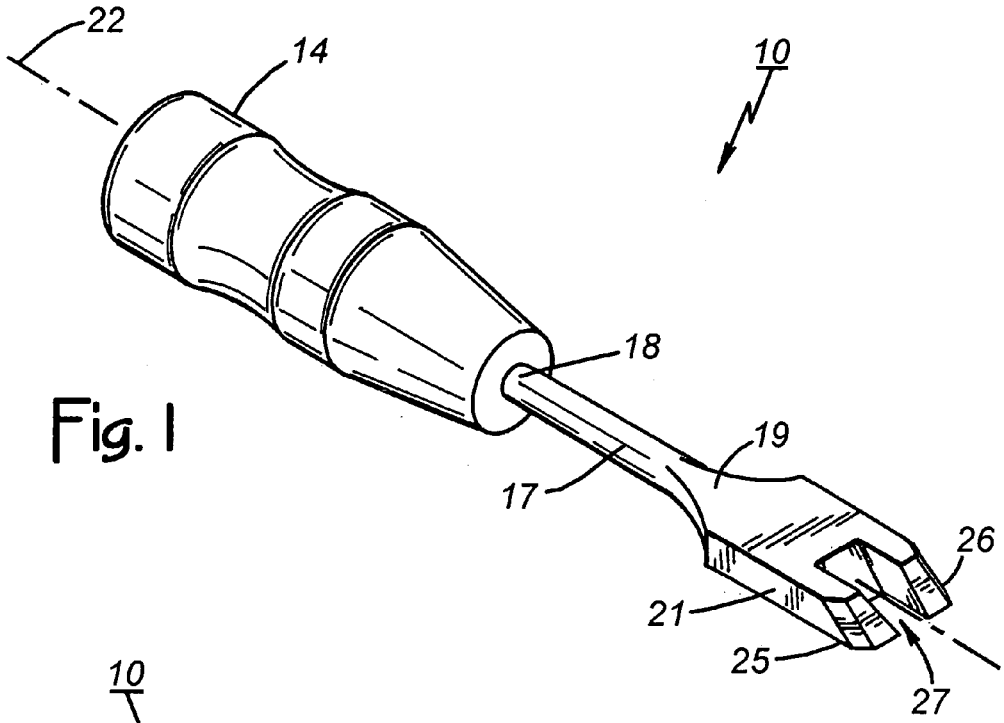
FIG. 1 of the drawings is an isometric view showing the top, front, and right side of a hinge pin remover tool constructed according to the invention.

FIGS. 1–7 of the drawings show various aspects of a hinge pin remover tool 10 constructed according to the invention. It facilitates removal of a hinge pin 11 from a hinge 12 having first and second hinge sections 13 and 14 as shown in FIG. 4. The hinge pin 11 (typically made of steel) includes a hinge pin shaft 15 with a predetermined hinge pin shaft diameter (e.g., 9/32 of an inch) and a hinge pin head 16 with a predetermined hinge pin head diameter (e.g., ½ of an inch) that is larger than the hinge pin shaft diameter.

Figure 2:
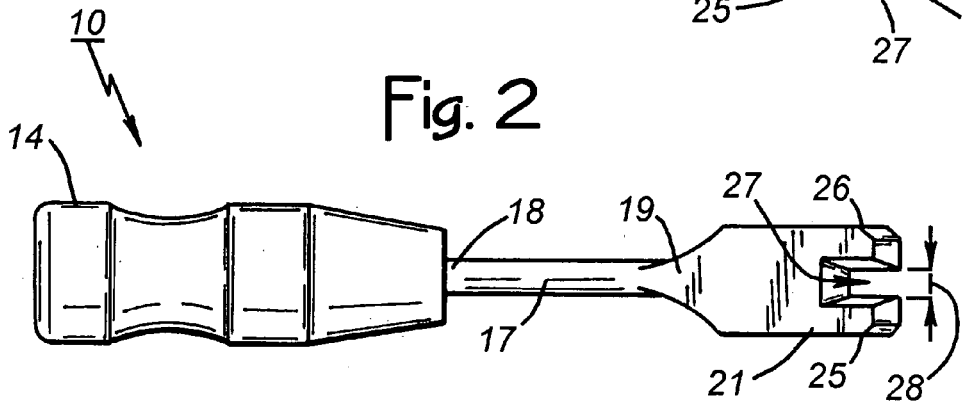
FIG. 2 is a top plan view of the hinge pin remover tool.
Figure 3:
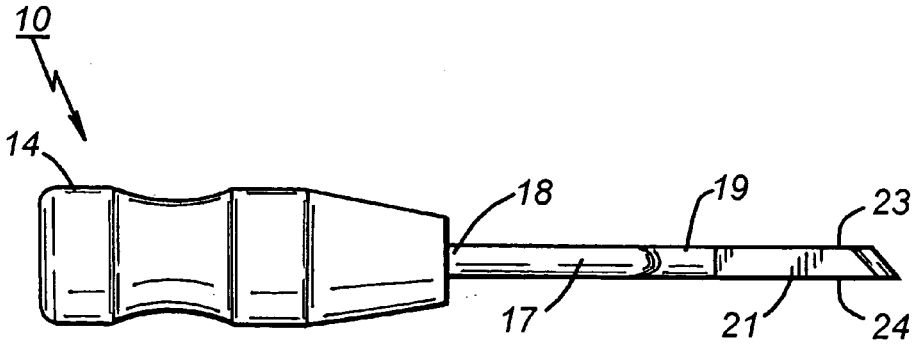
FIG. 3 is a side elevation view of the right side of the tool.

Generally, the tool 10 includes an elongated member in the form of a blade 17 having a proximal end portion 18 and a distal end portion 19 identified in FIGS. 1–3. The blade 17 may be composed of quarter-inch thick steel, for example, similar to the blade of a typical screwdriver or chisel. The tool 10 also includes a handle 14 (FIGS. 1–4) that is attached to the proximal end portion 18 of the blade 17 for a user to grasp in a hand 20 of the user (FIG. 4). In addition, the tool 10 includes a forked tip 21 on the distal end portion 19 of the blade 17 for the user to wedge between the hinge pin head 16 and the rest of the hinge 12 for purposes of facilitating hinge pin removal.

For the tool 10, the handle 14 and the blade 17, including the forked tip 21 of the blade 17, extend along a central axis of elongation 22 (FIG. 1) for a total length of the tool 10 that measures about seven inches. Of course, that dimension may vary significantly without departing from the inventive concepts described.

The forked tip 21 includes an upper side 23 and an under side 24 that are identified in FIG. 3. It is referred to as a "forked tip" because it resembles a fork in that it is divided into two or more branches or prongs (i.e., bifurcated). Thus, the forked tip 21 includes spaced apart first and second hinge-pin-dislodging prongs 25 and 26 that define a hinge-pin-shaft-receiving channel 27 extending along the central axis of elongation 22. The first and second prongs 25 and 26 are referred to as "hinge-pin-dislodging prongs" because they function to dislodge the hinge pin 11 from the rest of a hinge 12. Unlike the prongs of a common dinner fork and the like, the first and second prongs 25 and 26 are sufficiently large in cross sectional size so that they are rigid enough to not spread significantly when forced under the hinge pin head 16 (i.e., the width of the channel 27 does not increase appreciably in use).

The channel 27 that the first and second prongs 25 and 26 form has a uniform width between the first and second prongs 25 and 26 at the under side 24 that measures about ⅝ of an inch so that it is slightly greater than the predetermined hinge pin shaft diameter of the hinge pin shaft 15. The width of the channel 27 is indicated in FIG. 2 at reference numeral 28 between two opposing arrowheads in that view. With the width of the channel 27 slightly greater than the diameter of the hinge pin shaft 15, the channel 27 can receive the hinge pin shaft 15 as the forked tip 21 is wedged between the hinge pin head 16 and the rest of the hinge 11 as shown in FIG. 4. Based upon the foregoing and subsequent descriptions, one of ordinary skill in the art can readily implement the invention, including providing a different channel width in order to accommodate a hinge pin shaft having a different diameter than the 9/16 of an inch diameter of the hinge pin shaft 15. Different channel widths are intended to fall within the scope of the claims.

In order to facilitate use of the tool 10, the first and second prongs are preferably beveled. The first and second prongs 25 and 26 include first and second beveled surfaces 29 and 30 (FIGS. 5 and 6*a*) that extend to first and second edges 31 and 32 at the under side 24 so that the width of the channel 27 at the upper side 23 is greater than the width of the channel 27 at the under side 24. FIG. 6*b* is a diagrammatic representation 33 of the trapezoidal cross section of the channel 27 that results.

The trapezoidal cross section facilitates use of the tool 10 because the first and second beveled surfaces 29 and 30 wedge more easily between the hinge pin head 16 and the rest of the hinge 12 as the user advances the edges 31 and 32 under the hinge pin head 16. The illustrated forked tip 21 is also further beveled to result in a third beveled surface 34 that extends to a third edge 35 at the under side 24 (FIGS. 6*a* and 7). As the user continues to advance the forked tip 21 beneath the hinge pin head 16, the third beveled surface 34 eventually wedges between the hinge pin head 16 and the rest of the hinge 12 as the edge 35 moves beneath the hinge pin head 16.

Figure 8:
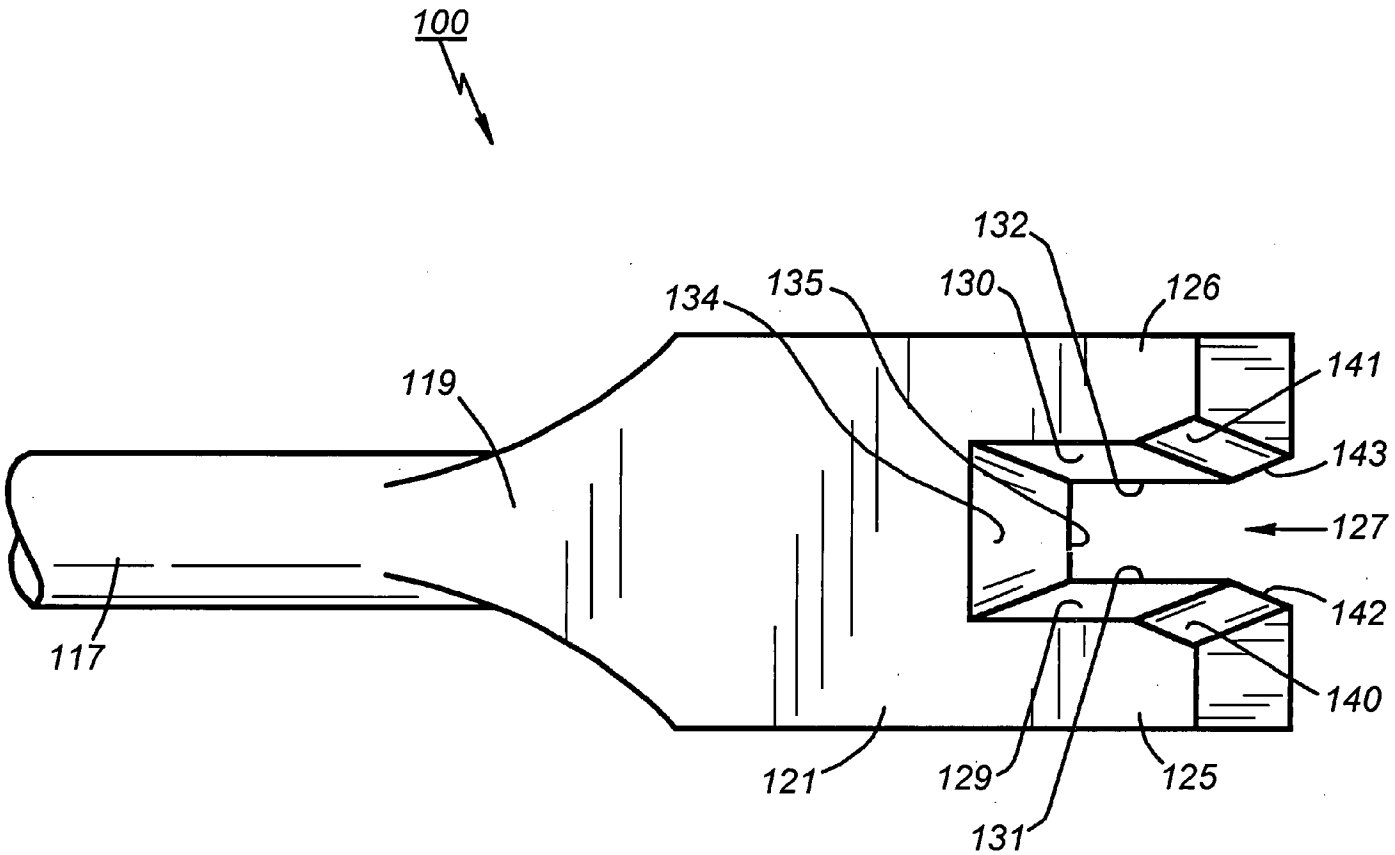
FIG. 8 is a top plan view similar to FIG. 2 of a portion of a second embodiment of a hinge pin remover tool constructed according to the invention that has a differently beveled tip portion that defines a distally enlarged channel.

Turning now to FIG. 8, it shows a second embodiment of a hinge pin remover tool constructed according to the invention that is identified as a tool 100. The tool 100 is similar in many respects to the tool 10 and so only differences are described in further detail. For convenience, reference numerals designating parts of the tool 100 are increased by one hundred over the reference numerals designating similar, related, or corresponding parts of the tool 10.

Similar to the tool 10, the tool 100 includes a blade 117 having a distal end portion 119 and a forked tip 121 on the distal end portion 119. The forked tip 121 includes first and second hinge-pin-dislodging prongs 125 and 126 that define a hinge-pin-shaft-receiving channel 127 bounded by first, second, and third beveled surfaces 129, 130, and 134 that extend to first, second, and third edges 131, 132, and 135.

The major difference embodied in the tool 100 is that the channel 127 has a width between the first and second edges 131 and 132 that increases distally. In other words, the width of the channel 127 is larger along the channel 127 further away from the third edge 135 (i.e., between the fourth and fifth edges 142 and 143) than the width is closer to the third edge 135 (i.e., between the first and second edges 131 and 132). That configuration results from fourth and fifth beveled edges 140 and 141 that extend to fourth and fifth edges 142 and 143. As the user advances the forked tip 121 toward the hinge pin 12, the fourth and fifth edges 142 and 143 advance beneath the hinge pin head 16 and thereby enable the fourth and fifth beveled surfaces 140 and 141 to wedge between the hinge pin head 16 and the rest of the hinge 12.

Thus, the invention provides a dedicated hinge pin remover tool having a forked tip that facilitates hinge pin removal. The user wedges the forked tip between the hinge pin head and the rest of the hinge and then dislodges the hinge pin with a prying action of the forked tip against the hinge pin head. Although exemplary embodiments have been shown and described, one of ordinary skill in the art may make many changes, modifications, and substitutions without necessarily departing from the spirit and scope of the invention.

What is claimed is:

1. A tool for removing a hinge pin from the rest of a hinge when the hinge pin includes a hinge pin shaft with a predetermined hinge pin shaft diameter measuring on the order of approximately 0.28 inches and a hinge pin head with a predetermined hinge pin head diameter measuring on the order of approximately 0.5 inches, the tool comprising:

an elongated member having a proximal end portion and a distal end portion;

a handle on the proximal end portion of the elongated member for a user to grasp in a hand of the user; and a forked tip on the distal end portion of the elongated member for the user to wedge between the hinge pin head and the rest of the hinge for purposes of facilitating hinge pin removal;

wherein the handle, the elongated member, and the distal end portion of the elongated member extend along a central axis of elongation;

wherein the forked tip on the distal end portion of the elongated member includes spaced apart first and second hinge-pin-dislodging tongs that define a channel having a width between the first and second hinge-pin-dislodging tongs that is larger than said predetermined hinge pin shaft diameter and smaller than said predetermined hinge pin head diameter in order to enable the channel to receive the hinge pin shaft as the user wedges the first and second hinge-pin-dislodging tongs between the hinge pin head and the rest of the hinge;

wherein the first hinge-pin-dislodging tong includes a first beveled surface that is beveled toward the second hinge-pin-dislodging tong;

wherein the second hinge-pin-dislodging tong includes a second beveled surface that is beveled toward the first hinge-pin-dislodging tong;

wherein the elongated member includes a third beveled surface facing away from the proximal end portion of the elongated member, said third beveled surface extending intermediate the first and second beveled surfaces transversely to the central axis of elongation; and wherein the width of the channel increases with increased distance along the central axis of elongation from the proximal end portion of the elongated member toward the distal end portion of the elongated member.

2. A tool as recited in claim 1, wherein the elongated member is composed of metal.

3. A tool as recited in claim 1, wherein the channel has a length that is about three-eighths of an inch long.

* * * * *